US006241799B1

(12) United States Patent
Galli

(10) Patent No.: US 6,241,799 B1
(45) Date of Patent: Jun. 5, 2001

(54) CORROSION RESISTANT CEMENTED CARBIDE

(75) Inventor: Enrico Galli, Boksburg (ZA)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/506,441

(22) Filed: Feb. 18, 2000

Related U.S. Application Data

(60) Continuation of application No. 08/732,833, filed on Oct. 15, 1996, now abandoned, which is a division of application No. 07/825,271, filed on Jan. 24, 1992, now abandoned.

(30) Foreign Application Priority Data

Jan. 25, 1991 (SE) ..... 9100227

(51) Int. Cl.[7] ..... C22C 29/02

(52) U.S. Cl. ..... 75/236; 75/240; 75/242; 83/835

(58) Field of Search ..... 75/236, 240, 242; 148/408, 410, 425, 427; 83/835

(56) References Cited

U.S. PATENT DOCUMENTS

| | | | |
|---|---|---|---|
| 4,497,660 | 2/1985 | Lindholm | 75/240 |
| 4,684,405 | 8/1987 | Kolaska et al. | 75/240 |
| 4,950,328 | 8/1990 | Odani et al. | 75/240 |
| 5,068,149 | 11/1991 | Shimada | 428/367 |
| 5,925,197 | 7/1999 | Galli | 148/409 |

FOREIGN PATENT DOCUMENTS

| | | |
|---|---|---|
| 1019470 | 11/1957 | (DE) . |
| 3837006 | 5/1990 | (DE) . |
| 0195965 | 10/1986 | (EP) . |
| 214679 | 3/1987 | (EP) . |
| 0385316 | 9/1990 | (EP) . |
| WO8002569 | 11/1980 | (WO) . |

OTHER PUBLICATIONS

Patent Abstracts of Japan, vol. 9, No. 293 (C–315), abstract of JP 60–135552.

Patent Abstracts of Japan, vol. 10, No. 161 (C–352), abstract of JP 61–12847.

Patent Abstracts of Japan, vol. 10, No. 245 (C–368), abstract of JP 61–76645.

Patent Abstracts of Japan, vol. 10, No. 245 (C–368), abstract of JP 61–76646.

Patent Abstracts of Japan, Vol. 13, No. 179 (C–590), abstract of JP 01–8245.

Patent Abstracts of Japan, vol. 13, No. 241 (C–604), abstract of JP 01–52043.

Kenneth J. A. Brookes, "International Carbide Data", World Directory and Handbook for Hard Metals, Fourth Edition, pp. 15–16.

*Primary Examiner*—George Wyszomierski
(74) *Attorney, Agent, or Firm*—Burns, Doane, Swecker & Mathis, L.L.P.

(57) ABSTRACT

The present invention discloses a sintered cemented carbide alloy with excellent corrosion and oxidation resistance. The alloy comprises 70–98 weight-% hard material essentially comprising WC in a monophase binder phase. It has been found that by the use of submicron WC the corrosion and oxidation resistance can be improved compared to known corrosion and oxidation resistant cemented carbide alloys.

8 Claims, No Drawings

CORROSION RESISTANT CEMENTED CARBIDE

This application is a continuation of application Ser. No. 08/732,833, filed Oct. 15, 1996, abandoned, which is a divisional of application Ser. No. 07/825,271, filed Jan. 24, 1992, abandoned.

BACKGROUND OF THE INVENTION

The present invention relates to a new cemented carbide grade with excellent properties especially for tools in the wood industry. More particularly, the invention relates to a cemented carbide in which submicron WC has been distributed in a monophase binder phase based on Ni, Co and Cr.

Reconstituted wood products, such as medium density fiberboard and chipboard, are the main raw materials in the furniture industry. They are also used to some extent in the housing industry.

These products are machined with a variety of tool materials, from high speed steels to cemented carbide to polycrystalline diamond. A leading role has been played and is still being played by tools made with cemented carbides.

The composition of the cemented carbide grades used for wood working tools consists generally of tungsten carbide (WC), as the hard component, and cobalt (Co) as a binder to hold together the WC crystals. Sometimes small amounts of other carbides, like titanium carbide, tantalum carbide, etc., are added.

To satisfy the different demands on hardness and toughness, the amount of Co and/or the grain size of the WC are varied. Higher Co-content and/or larger grain size decrease hardness and increase toughness.

Mechanical wear, especially abrasion, has been thought to be the primary mechanism of tool wear when machining reconstituted wood products. Recent work, however, has proven that chemical mechanisms such as corrosion and oxidation play a significant role in tool degradation. The same is valid also for tools for machining of printed circuit boards and similar composite materials.

As these wood products are machined, the tool temperature can increase dramatically. As the temperature increases, the wood products go through thermal breakdown resulting in the introduction of numerous chemicals into the cutting environment. In all, up to 213 different compounds have been identified upon the destructive distillation of wood. The machining of medium density fiberboard and particle board produces even more decomposition products. These products not only have the wood fibers, but also a binder such as urea, formaldehyde, wax and glue fillers and extenders, and possibly chemicals added as flame retardants.

The decomposition products formed are highly corrosive and attack the Co-binder that holds the WC grains together. When this occurs, the WC grains are removed by mechanical action and the tool cutting edge loses its sharpness and its cutting capability.

The high temperature achieved when machining wood products contributes also to the degradation of the binder by oxidation of the Co in air.

What has been said above is also valid when cutting green lumber or dried wood. Both products contain moisture and organic acids capable of dissolving the Co-binder and therefore weakening the bond holding the carbide particles in place until the exposed particles are removed mechanically.

OBJECTS AND SUMMARY OF THE INVENTION

It is an object of the present invention to avoid or alleviate the problems of the prior art.

It is a further object of the present invention to provide an improved cemented carbide for use in the machining of wood or wood products.

In one aspect of the present invention, there is provided a sintered cemented carbide alloy with improved corrosion and oxidation resistance comprising 70–98 weight-% hard material comprising WC in a monophase binder phase based on Ni and/or Co, said binder phase comprising in solution, in weight-%, Co max 90, Ni max 90, Cr 3–15, W max 30, Mo max 15, the total carbon content, in weight-%, is $6.13-(0.061\pm A)\times(100-\text{hard material in weight-\%})$ for concentrations of Mo+Cr between 3–15 weight-% where A=0.008 and $6.13-(0.058\pm B)\times(100-\text{hard materials in weight-\%})$ for concentrations of Mo+Cr between 16–30 weight-% where B=0.007, the mean grain size of WC being <0.9 μm, and the alloy further containing <0.8% VC and/or ZrN.

In other aspects of the present invention there are provided the use of the sintered cemented carbide alloy as discussed above for cutting of wood and wood products.

DETAILED DESCRIPTION OF THE PREFERRED EMBODIMENTS OF THE INVENTION

The present invention relates to new types of cemented carbide with excellent properties regarding corrosion and oxidation resistance particularly satisfying the different needs of the wood industry. The other properties distinctive of cemented carbides, like resistance to abrasion, toughness and brazability, have been kept to an optimum.

Resistance to corrosion and oxidation has been achieved by alloying the binder and distributing it in a cemented carbide structure consisting of submicron WC grains, which permit an optimal distribution of the binder, resulting in a structure consisting of both thin layers of binder and small WC grains. The large surface to volume ratio of the submicron WC grains permits an optimal anchorage of the grains to the binder.

The material according to the invention comprises 70–98 weight-% hard material which is essentially WC with a mean grain size smaller than 0.9 μm, preferably smaller than 0.7 μm, most preferably smaller than 0.5 μm. In addition, the material contains max 0.8 weight-%, preferably max 0.2 weight-%, of VC and/or ZrN. The binder phase comprises in solution, in weight-%, Co max 90, Ni max 90, Cr 3–15, W max 30, Mo max 15 and, in addition Al max 2, Mn max 10, Si max 2, Cu max 10, Fe max 20, Ag max 5 and Au max 10. In a preferred embodiment, the binder phase is Ni-based and also comprises in solution, in weight-%, Co max 30 and Mo 1–6. In another preferred embodiment, the binder phase comprises in solution, in weight-%, Co 30–70 and Mo 1–6. The binder phase may also comprise in solution 0.1–10 weight-% TiN and/or TiCN.

The concentration of carbon in the sintered cemented carbide must be kept within a narrow range. This condition must be fulfilled in order to obtain a monophase binder and to prevent the formation of brittle carbides. The optimal concentration of carbon to retain high resistance to corrosion and oxidation as well as toughness must be, in percentage by weight, $6.13-(0.061\pm A)\times(100-\text{hard material in weight-\%})$ for concentration of Cr+Mo between 3–15 weight-% and where A=0.008, preferably A=0.005, and $6.13-(0.058\pm B)\times(100-\text{hard materials in weight-\%})$ for concentration of Cr+Mo between 16–30 weight-% where B=0.007, preferably B=0.005.

The cemented carbide alloys according to the invention are manufactured by powder metallurgical methods, namely, milling, pressing and sintering. The grain size of the WC powder shall be <0.8 μm, preferably <0.6 μm. By the addition of small amounts of VC and/or ZrN, the WC grain growth during sintering is inhibited.

The cemented carbide according to the invention is particularly useful for cutting of chipboard, medium density fiberboard, particle board and solid dried and wet wood. For cutting of chipboard, medium density fiberboard and particle board, the binder phase content shall be max 4 weight-%, preferably max 3 weight-%, for cutting of solid dried wood the binder phase content shall be 4–9 weight-%, preferably 4–6 weight-%, and for cutting of solid wet wood the binder phase content shall be 10–30 weight-%. The cemented carbide according to the invention is also useful for tools such as drills, microdrills and routers for machining of printed electronic circuit boards and similar composite materials. In this application the binder content shall be 3–20 weight-%, preferably 4–12 weight-%.

The invention is additionally illustrated in connection with the following Example which is to be considered as illustrative of the present invention. It should be understood, however, that the invention is not limited to the specific details of the Example.

EXAMPLE

A cemented carbide grade according to the invention with the following composition in weight-%: Co 1.9, Ni 0.7, Cr 0.3, VC 0.2 and balance WC with a mean grain size of 0.6 μm was tested against a corrosion and oxidation resistant WC-Ni—Cr—Mo alloy disclosed in U.S. Pat. No. 4,497,660, see particularly example 7, and a straight WC-Co material both with the same binder phase content. In the test, chipboard 20 mm covered on both sides with a 0.16 mm layer of melamine has been machined using a milling cutter and the following cutting data:

| | |
|---|---|
| diameter of cutter | 125 mm |
| cutting depth | 3 mm |
| cutting speed | 40 m/s |
| feed | 6 m/min |
| cutting edge angle | 55 |
| rake angle | 20 |
| clearance angle | 15 |

The edge wear of the cutting edge as well as the surface finish of the chipboard were measured at 0, 2000, 5000, 20000 and 40000 meters.

The following results were obtained:

Average wear in μm at different cutting lengths, m

| | 2000 | 5000 | 20000 | 40000 |
|---|---|---|---|---|
| According to the invention | 25 | 37 | 73 | 87 |
| WC + Ni + Cr + Mo | 36 | 54 | 90 | 104 |
| WC + Co | 42 | 56 | 106 | 141 |

The cemented carbide according to the invention shows significantly lower wear than the conventional carbides. The conventional type of corrosion and oxidation resistant cemented carbide shows at 20000 meters about the same wear as the new type at 40000 meters.

The surface finish produced by the inserts of the straight WC-Co cemented carbide was found unacceptable after 20000 meters, while for the inserts in the new type of cemented carbide, the surface finish was still acceptable after 40000 meters.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of cutting chip board, medium density fiberboard and particle board comprising a step of utilizing a wood cutting tool for cutting said chip board, medium density fiberboard and particle board, said wood cutting tool comprising a sintered cemented carbide alloy having improved corrosion and oxidation resistance, said alloy comprising at least 96 weight-% hard material comprising WC in a monophase binder phase based on Ni and/or Co, said binder phase comprising in solution, in weight-%, Co max 90, Ni max 90, Cr 3–15, W max 30, Mo max 15, the total carbon content, in weight-%, is 6.13–(0.061±A)×(100 minus hard material in weight-%) for concentrations of Mo+Cr between 3–15 weight-% where A=0.005 to 0.008 and 6.13–(0.058±B)×(100–hard materials in weight-%) for concentrations of Mo+Cr between 16–30 weight-% where B=0.005 to 0.007, the mean grain size of WC being ≦0.7 μm, and the alloy optionally containing up to 0.8% each of VC and ZrN.

2. The method of claim 1, wherein said binder phase comprises in solution, in weight-%, Co max 30 and Mo 1–6.

3. The method of claim 1, wherein said binder phase comprises in solution, in weight-%, Co 30–70 and Mo 1–6.

4. The method of claim 1, wherein said binder phase further comprises in solution, in weight-%, Al max 2, Mn max 10, Si max 2, Cu max 10, Fe max 20, Ag max 5 and Au max 10.

5. The method of claim 1, wherein said binder phase comprises in solution 0.1–10 weight-% TiN and/or TiCN.

6. The method of claim 1, wherein A=0.005 and B=0.005.

7. The method of claim 1, wherein the mean grain size of WC is ≦0.6, μm.

8. The method of claim 1, wherein the alloy contains less than 0.2% of VC and less than 0.2% ZrN.

* * * * *